US008430528B2

(12) United States Patent
Yu et al.

(10) Patent No.: US 8,430,528 B2
(45) Date of Patent: Apr. 30, 2013

(54) LED BULB

(75) Inventors: Guang Yu, Shenzhen (CN); Qian Xiang, Shenzhen (CN)

(73) Assignees: Fu Zhun Precision Industry (Shen Zhen) Co., Ltd., Shenzhen (CN); Foxconn Technology Co., Ltd., New Taipei (TW)

( * ) Notice: Subject to any disclaimer, the term of this patent is extended or adjusted under 35 U.S.C. 154(b) by 274 days.

(21) Appl. No.: 13/044,507

(22) Filed: Mar. 9, 2011

(65) Prior Publication Data

US 2012/0161602 A1 Jun. 28, 2012

(51) Int. Cl.
*F21V 21/00* (2006.01)

(52) U.S. Cl.
USPC ..... 362/249.02; 362/294; 362/373; 313/46

(58) Field of Classification Search ..... 362/249.02, 362/294, 373; 313/46
See application file for complete search history.

(56) References Cited

U.S. PATENT DOCUMENTS

| | | | | |
|---|---|---|---|---|
| 7,461,951 | B2 * | 12/2008 | Chou et al. | 362/294 |
| 7,575,346 | B1 * | 8/2009 | Horng et al. | 362/373 |
| 7,581,856 | B2 * | 9/2009 | Kang et al. | 362/373 |
| 7,841,752 | B2 * | 11/2010 | Lee | 362/373 |
| 2009/0046473 | A1 * | 2/2009 | Tsai et al. | 362/373 |
| 2009/0237932 | A1 * | 9/2009 | Lee | 362/249.02 |
| 2009/0290343 | A1 * | 11/2009 | Brown et al. | 362/235 |
| 2010/0124058 | A1 * | 5/2010 | Miller | 362/249.02 |
| 2010/0165632 | A1 * | 7/2010 | Liang | 362/294 |
| 2010/0181889 | A1 * | 7/2010 | Falicoff et al. | 313/46 |
| 2010/0232168 | A1 * | 9/2010 | Horng et al. | 362/373 |
| 2011/0032708 | A1 * | 2/2011 | Johnston et al. | 362/294 |

* cited by examiner

*Primary Examiner* — Mary Ellen Bowman
(74) *Attorney, Agent, or Firm* — Altis Law Group, Inc.

(57) ABSTRACT

An LED bulb includes a connector, a heat sink disposed on the connector, an LED module, and an envelope secured to the heat sink and covering the LED module. The heat sink includes a tubular body defining a central through hole, a plurality of fins, and a supporting body located in the tubular body and interconnecting inner edges of the fins. The LED module is attached on the supporting body of the heat sink. A fan is received in the tubular body. When the LED bulb is at work, the fan generates an airflow which flows from an outer environment through the tubular body, the through hole, the LED module, the fins and finally the tubular body to return to the outer environment, thereby to effectively take away the heat generated by the LED module.

16 Claims, 4 Drawing Sheets

LED BULB

BACKGROUND

1. Technical Field

The disclosure relates to light emitting diode (LED) bulbs for illumination purpose and, more particularly, relates to an LED bulb having a good heat dissipation.

2. Description of Related Art

LED bulbs are a type of solid-state lighting that utilizes LED as a light source for indoor or outdoor illumination. An LED bulb generally requires a plurality of LEDs mostly driven at the same time, which results in a rapid rise in operating temperature of the LEDs. However, since the bulb lacks effective heat dissipation mechanisms, continuous operation of the LED bulb can cause overheat of the LEDs, resulting in flickering or even malfunction of the LEDs.

What is needed, therefore, is an improved LED bulb which can overcome the above problems.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION

Figure 1:
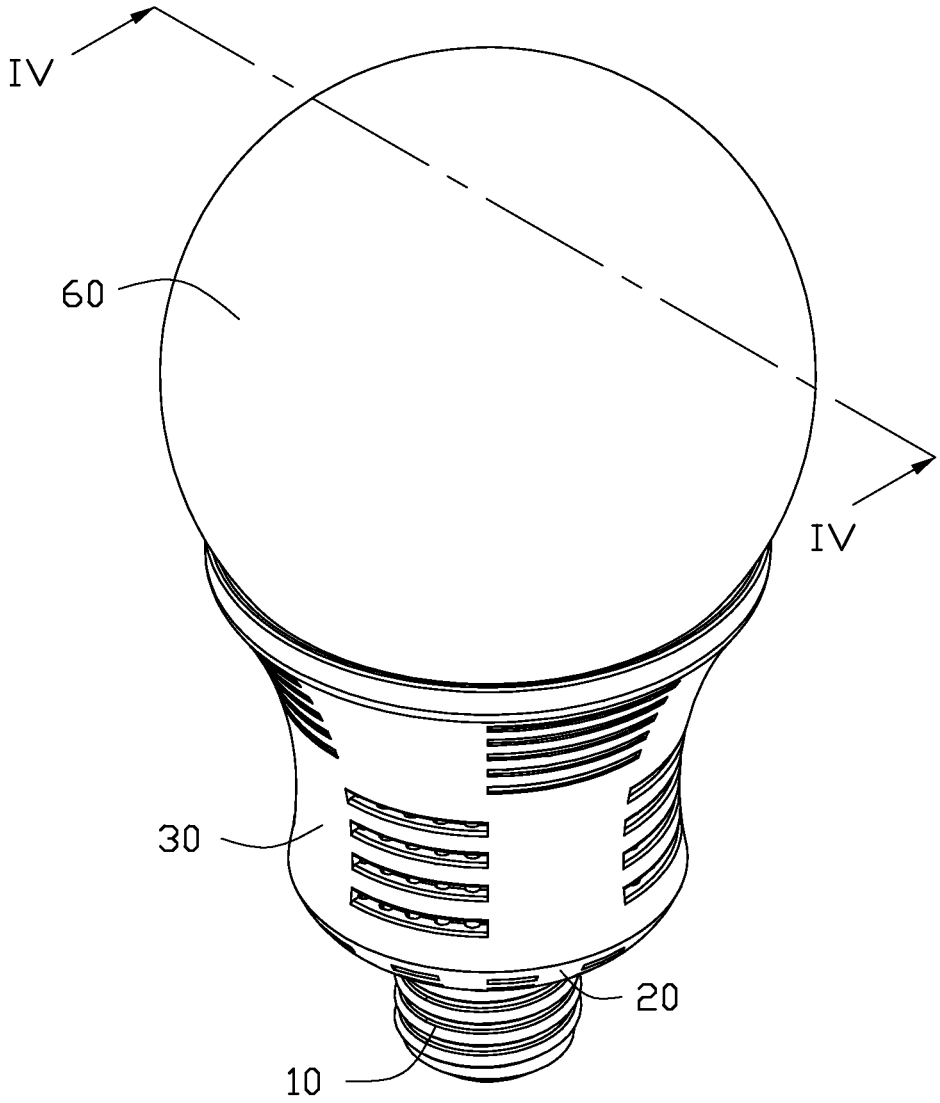
FIG. 1 is an assembled view of an LED bulb in accordance with an embodiment of the disclosure.
Figure 2:
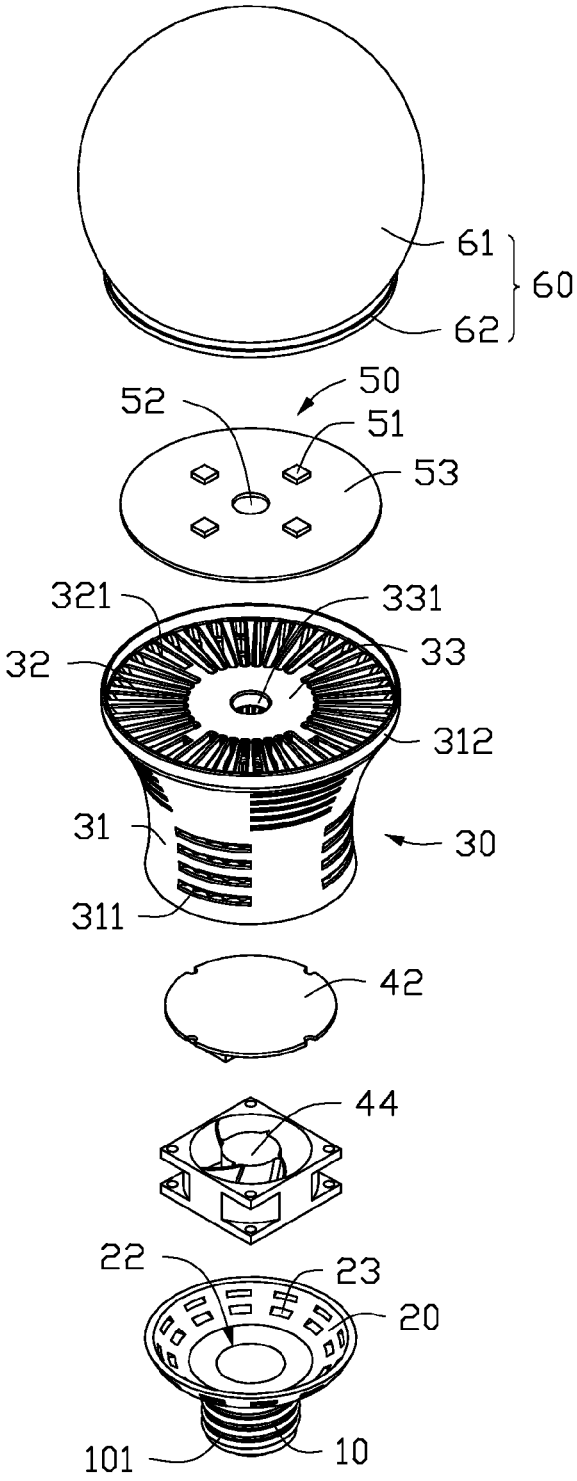
FIG. 2 is an exploded view of the LED bulb of FIG. 1.

Referring to FIGS. 1 and 2, a light emitting diode (LED) bulb in accordance with an embodiment of the disclosure is illustrated. The LED bulb comprises a connector 10, a seat 20 engaging with the connector 10, a heat sink 30 disposed on the seat 20, a fan 44 received in the heat sink 30, an LED module 50 mounted on the heat sink 30, and an envelope 60 secured to the heat sink 30 and covering the LED module 50.

The connector 10 is used to electrically connect with a power supply. The connector 10 is a standard cap defining a plurality of threads 101, which can be suited with a conventional lamp socket. The seat 20 is bowl-shaped, and fixed on a top of the connector 10. The seat 20 defines a cavity 22 therein and engages with a bottom of the heat sink 30. The seat 20 defines a plurality of through slots 23 communicating the cavity 22 with an outer environment. The through slots 23 are spaced from each other, and arranged in a circumferential periphery of the seat 20. Each through slot 23 is rectangular and extends along a circumferential direction of the periphery of the seat 20.

Figure 3:
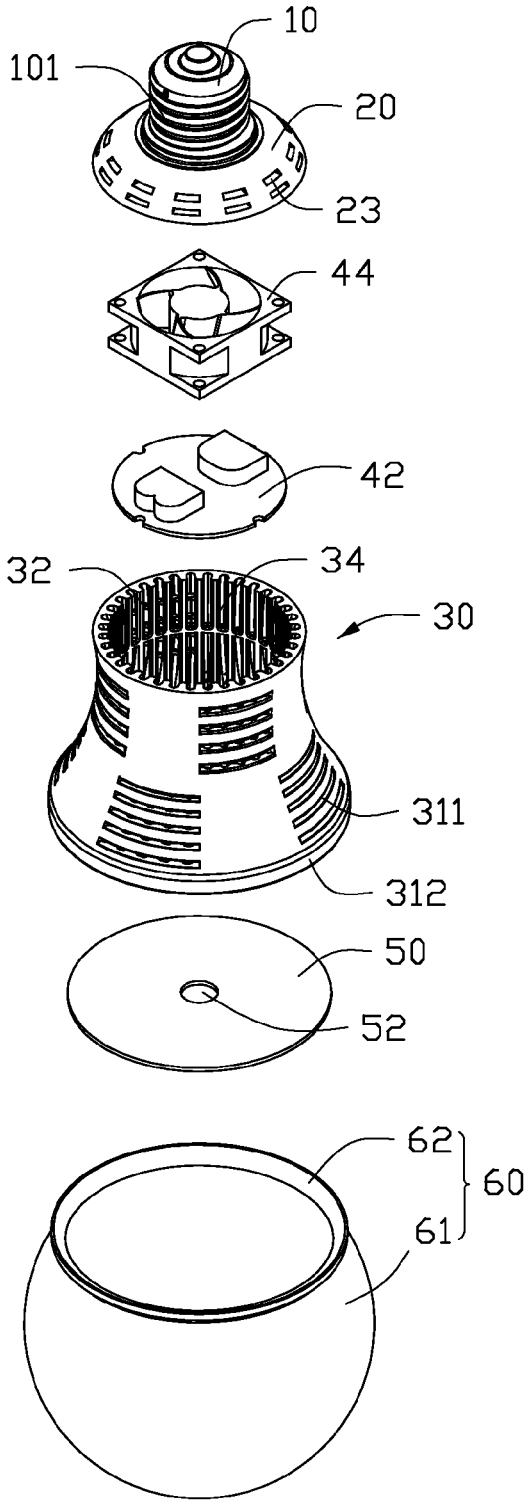
FIG. 3 is an inverted view of the LED bulb of FIG. 2.
Figure 4:
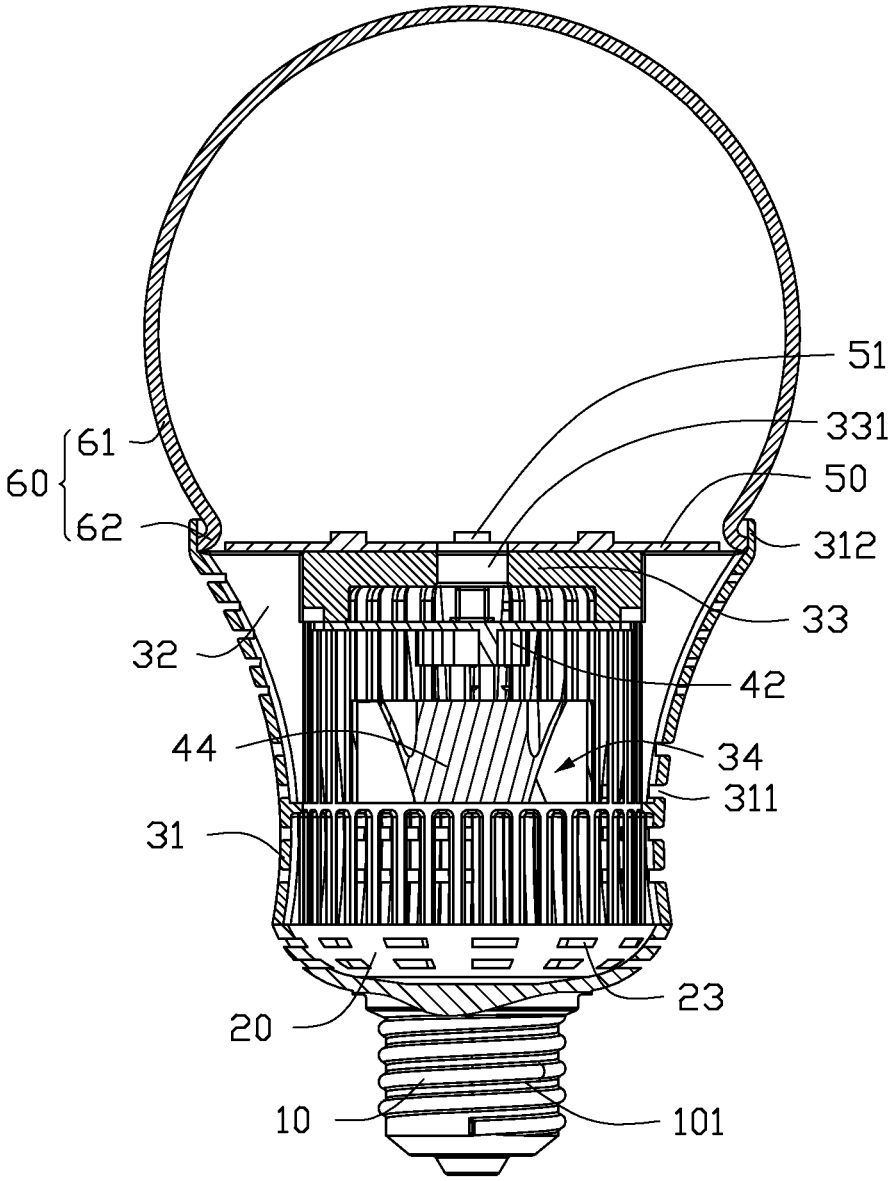
FIG. 4 shows a cross sectional view of the LED bulb of FIG. 1, taken along line IV-IV thereof.

Referring to FIGS. 3 and 4 also, the heat sink 30 is integrally made of aluminum. The heat sink 30 comprises a tubular body 31, a plurality of fins 32 extending inwardly from an inner circumference of the tubular body 31, and a supporting body 33 on which the LED module 50 is attached. The tubular body 31 defines a through hole 34 in a central portion thereof. The fan 44 is correspondingly received in the through hole 34. A diameter of the tubular body 31 gradually increases along a bottom-to-top direction thereof. The supporting body 33 is located in the through hole 34, and a top face of the supporting body 33 is coplanar with top faces of the fins 32. An outer circumference of the supporting body 33 interconnects edges of the fins 32; in other words, the supporting body 33 is surrounded by the fins 32. The supporting body 33 defines a first hole 331 at a center portion thereof. The fins 32 are spaced from each other. Each fin 32 extends radially outwards from the supporting body 33. A passage 321 is defined between every two neighboring fins 32. The fins 32 extend along an axial direction of the tubular body 31. The tubular body 31 defines a plurality of through grooves 311 communicating with the passages 321 of the fins 32 and the outer environment. The through grooves 311 each are rectangular and extend along a circumferential direction of the tubular body 31. The through grooves 311 are divided into two groups staggered with each other, wherein one group (i.e., an upper group) is located adjacent a top of the tubular body 31, and the other group (i.e., a lower group) is located adjacent a bottom of the tubular body 31. The LED bulb further comprises a driving module 42 which is electrically connected to the connector 10 and the LED module 50. The driving module 42 is configured for providing driving voltage for the LED module 50. The driving module 42 is accommodated in the through hole 34, and fixed to a bottom face of the supporting body 33. The fan 44 is located below the driving module 42.

The LED module 50 comprises a circular printed circuit board 53 and a plurality of LEDs 51 mounted on the printed circuit board 53. The printed circuit board 53 is thermally attached on the top face of the supporting body 33 of the heat sink 30. The LEDs 51 are arranged evenly on the printed circuit board 53 and spaced from each other. It is understood that the number of the LEDs 51 is not limited to the present embodiment; the number of the LEDs 51 can also be two, three, etc. The printed circuit board 53 is annular, and defines a second hole 52 at a center thereof. The first and second holes 331, 52 are communicated with each other and the through hole 34 of the heat sink 30.

The envelope 60 is disposed on the heat sink 30 and correspondingly covers the LED module 50. The envelope 60 is integrally formed of a transparent or semitransparent material such as glass, resin or plastic. The envelope 60 comprises a bowl-shaped body 61 and an engaging flange 62 extending downwardly from a periphery of a bottom end of the body 61. The engaging flange 62 of the envelope 60 is fitly engaged with a top end 312 of the tubular body 31. Furthermore, the envelope 60 can function to modulate the light generated by the LEDs 51 to a desired pattern.

The LED bulb further comprises an annular gasket (not shown) sandwiched between the engaging flange 62 of the envelope 60 and the heat sink 30. The gasket is made of rubber, for increasing the sealing performance of the LED bulb.

When the LED bulb is at work, the fan 44 is driven to rotate to generate an airflow. The airflow flows from the outer environment through the through slots 23 of the seat 20 and the lower group of the through grooves 311 of the heat sink 30 to enter the through hole 34. Then the airflow flows through the first and second holes 331, 52 to enter the envelope 60. Finally, the airflow leaves the envelope 60 via the passages between the fins 32 and the upper group of the through grooves 311 to return to the outer enviornment. Thus, the heat generated by the LEDs 51 can be effectively dissipated to the outer environment.

It is to be understood, however, that even though numerous characteristics and advantages of the disclosure have been set forth in the foregoing description, together with details of the structure and function of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An LED bulb comprising:

a connector for being electrically connected to a power supply;

a heat sink disposed on the connector, the heat sink comprising a tubular body defining a through hole at a center thereof, a plurality of fins extending inwardly from an inner circumference of the tubular body, and a supporting body located in the tubular body and connecting with inner edges of the fins, wherein the fins are spaced from each other, and a passage is defined between every two neighboring first fins, and wherein the tubular body defines a plurality of through grooves divided into a first group and a second group, the first group of the through grooves communicating an outer environment with the through hole;

an LED module mounted on the supporting body of the heat sink and defining a through hole communicating with the through hole of the tubular body, the second group of the through grooves communicating with the through hole of the LED module via the passage;

an envelope secured to the heat sink and covering the LED module; and a fan received in the tubular body, when the fan is driven to generate an airflow, the airflow first flowing from the outer environment to enter the central hole of the tubular body via the first group of the through grooves, then flowing through the central hole of the LED module to enter the envelope, and finally leaving the envelope through the passage and the second group of the through grooves to return to the outer environment.

2. The LED bulb as described in claim 1, wherein the first group of the through grooves is located adjacent a bottom of the tubular body near the connector, and the second group of the through grooves is located adjacent a top of the tubular body near the envelope, and the two groups of the through grooves are staggered with each other.

3. The LED bulb as described in claim 1, wherein the through grooves each are rectangular and extend along a circumferential direction of the tubular body, and the fins extend along an axial direction of the tubular body.

4. The LED bulb as described in claim 1, wherein a top face of the supporting body is coplanar with top faces of the fins.

5. The LED bulb as described in claim 1, wherein the supporting body is surrounded by the fins.

6. The LED bulb as described in claim 5, wherein the fins each are extended radially outward from the supporting body.

7. The LED bulb as described in claim 1, further comprising a seat fixed on a top of the connector, and the heat sink being disposed on the seat.

8. The LED bulb as described in claim 7, wherein the seat defines a cavity therein and engages with the heat sink.

9. The LED bulb as described in claim 8, wherein the seat defines a plurality of through slots communicating the cavity with the outer environment, the cavity communicating with the through hole of the tubular body.

10. The LED bulb as described in claim 1, wherein the envelope comprises a bowl-shaped body and an engaging flange extending downwardly from a periphery of a bottom end of the body.

11. The LED bulb as described in claim 1, wherein the supporting body defines a through hole at a center portion thereof.

12. The LED bulb as described in claim 11, wherein the LED module comprises an annular printed circuit board defining the through hole of the LED module at a center of the printed circuit board, and a plurality of LEDs mounted on the printed circuit board.

13. The LED bulb as described in claim 12, wherein the through hole of the supporting body communicates with and the through hole of the printed circuit board of the LED module.

14. An LED bulb comprising:

a connector for being electrically connected to a power supply;

a heat sink engaged with the connector, the heat sink comprising a tubular body, a plurality of fins extending inwardly and axially from an inner circumference of the tubular body with a through hole defined by inner free ends of the fins, and a supporting body positioned in a top of the tubular body and interconnecting with inner edges of the fins;

an LED module mounted on the supporting body of the heat sink; and an envelope secured to the heat sink and covering the LED module;

wherein a first hole is defined in the supporting body, and a second hole is defined in the LED module, the first and second hole being communicated with the through hole of the tubular body.

15. The LED bulb as described in claim 14, further comprising a fan received in the through hole of the tubular body and positioned below the supporting body.

16. The LED bulb as described in claim 14, wherein the tubular body defines a plurality of through grooves communicating the through hole of the tubular body.

* * * * *